US006089881A

United States Patent [19]

Daoud

[11] Patent Number: 6,089,881

[45] Date of Patent: Jul. 18, 2000

[54] GROUNDING HINGE

[75] Inventor: Bassel H. Daoud, Parsippany, N.J.

[73] Assignee: Lucent Technologies, Inc., Murray Hill, N.J.

[21] Appl. No.: 09/120,262

[22] Filed: Jul. 21, 1998

[51] Int. Cl.[7] ..... H01R 4/66

[52] U.S. Cl. ..... 439/92

[58] Field of Search ..... 439/92, 502, 420; 174/51, 35, 38; 245/5; 361/220, 212

[56] References Cited

U.S. PATENT DOCUMENTS

| | | | |
|---|---|---|---|
| 3,864,510 | 2/1975 | Ramsey, Jr. et al. | 174/38 |
| 3,987,613 | 10/1976 | Woods et al. | 57/256 |
| 4,398,277 | 8/1983 | Christiansen et al. | 361/220 |
| 4,577,256 | 3/1986 | Breidegam | 361/220 |
| 4,934,952 | 6/1990 | Banker | 439/92 |
| 5,605,474 | 2/1997 | Auclair | 439/505 |
| 5,917,149 | 6/1999 | Barcley et al. | 174/35 |

OTHER PUBLICATIONS 5 pages from Electric Motion Company, Inc. catalog featuring various braids.

Applicant's sample braid.

*Primary Examiner*—Gary F. Paumen
*Assistant Examiner*—Alexander Gilman
*Attorney, Agent, or Firm*—Synnestvedt & Lechner LLP

[57] ABSTRACT

An electrically conducting hinge formed from braided strands of wire is disclosed. The wires are braided into a fabric strip having edge portions with a plurality of apertures disposed longitudinally along the strip. Eyelets are disposed within the apertures to reinforce the apertures and provide bearing surfaces for mounting bolts to mount the hinge onto an electrical junction box.

19 Claims, 3 Drawing Sheets

GROUNDING HINGE

FIELD OF THE INVENTION

This invention relates to electrically conducting hinges for movably joining electrically conducting components, and more particularly to hinges that provide a low-resistance electrical connection between the components.

BACKGROUND OF INVENTION

Electrical junction boxes used in telecommunications provide an organized and convenient interface for connecting telephone lines in a building, for example, with the regional lines of a telephone system. One example of such a junction box is the "building entry protection" unit or BEP. The BEP also provides a point at which the system is locally grounded.

Grounding is important for reasons of system performance and safety. An effectively grounded BEP will reduce system cross talk, or the propensity of one line to inductively pick-up and carry the undesired signals of a neighboring line, causing interference between the two lines. Grounding is also important to protect users of the telephones in the event that lightning strikes the cable carrying the linesinto the building, or a high power electrical line contacts the telephone cable. A grounded BEP will conduct the electrical current from a lightning strike or electrical line safely to ground. An ungrounded BEP will allow the current to enter the telephone system within the building, damaging equipment and presenting a lethal hazard to anyone using a telephone.

One design of a BEP has a metal housing, mounted within the building, connected to a local ground by a grounding strap or other means well known in the art. Wire connectors, for example insulation displacement connectors (IDCs) having connection terminals on opposite ends, are mounted in the housing. A cable containing the outside telephone lines attached to the terminals on one end, telephone lines from telephones within the building are attached to the terminals on the other end.

It is convenient to mount the connectors on a metal frame that is hingedly attached to the housing. The frame pivots on the hinge to allow ready access to the inner terminals enclosed within.

Surge protectors are mounted on the wire connector to protect the system. When excess current is present, for example, during a lightning strike, the surge protector grounds the affected line to the metal frame of the BEP which is, in turn, electrically connected to the metal housing which in turn electrically connected to ground. Thus the current is effectively shunted to ground without entering the telephone system within the building if the path from the outside lines through the BEP frame, through the BEP housing and lastly through the grounding strap is a continuous path offering low electrical resistance. The article cable also has a metal shield that is grounded to the BEP and ultimately connected to the ground.

Typically hinge connections between the frame and the housing provide poor electrical connections which can compromise the path to ground. The hinge elements must move easily relative to each other and cannot be tightly bound together in contact, which is generally required for a good electrical connection. When it is necessary to electrically connect parts joined by a hinge, such as a conventional "piano" type hinge, a separate grounding strap is usually connected between the two parts to ensure a good electrical connection.

Accordingly it is an object of the invention to provide an electrically conducting hinge which provides a good electrical connection between the moving parts.

It is another object of the invention to provide an electrically conducting hinge which allows the moving parts to move easily and smoothly between an open and a closed position.

It is yet another object of the invention to provide an electrically conducting hinge with sufficient strength and stiffness to hold one moving part in an open position relative to the other.

It is still another object of the invention to provide an electrically conduction hinge which eliminates the need for a separate grounding strap between the moving parts.

These and other objects will become apparent from a consideration of the following drawings and description of the invention.

SUMMARY OF INVENTION

The electrically conducting hinge according to the invention comprises an elongated strip having a multiplicity of electrically conducting flexible fibers formed into a fabric. The strip has oppositely disposed first and second edge portions which extend longitudinally along the strip. A plurality of attachment points, preferably comprising apertures, are arranged longitudinally along each edge portion. The apertures are sized to accept fasteners and provide the means for attaching the hinge to the parts to be hingedly joined.

The fibers are made of an electrically conducting material, copper being preferred for its high conductivity. The fibers are formed into a fabric by any of several known means such as knitting or weaving, but braiding being preferred because it combines high shear capability with strength and flexibility which allows the hinge to support the weight of the hingedly attached component without undesired deformation.

Eyelets are mounted concentrically within each aperture to reinforce the apertures and provide a bearing point to effect a good electrical connection between the hinge and the component to which it is attached. The eyelets preferably have an annular flange on each end which is compressed against a respective surface of the hinge, thereby increasing the area of electrical contact between the eyelet and the hinge.

The electrically conducting hinge according to the invention replaces conventional hinges and grounding straps on a junction box. Bolts, screw, rivets, or other common fasteners can be used to attach each edge portion to a respective part of the junction box.

DETAILED DESCRIPTION OF PREFERRED EMBODIMENTS

Figure 1:
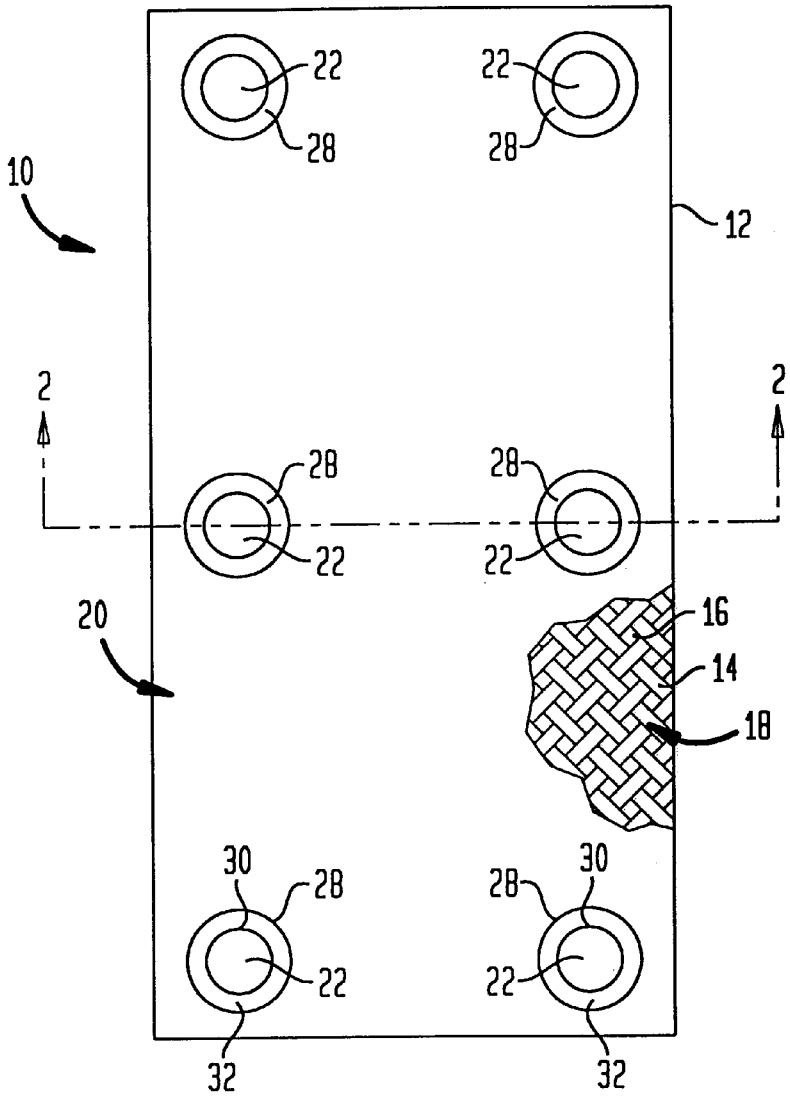
FIG. 1 shows a plan view of an electrically conducting hinge according to the invention.
Figure 5A:
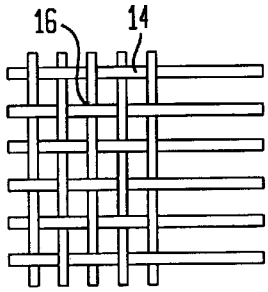
FIGS. 5*a*–5*c* are schematic diagrams depicting various means for intermeshing fibers to form a fabric such as used in forming the invention.
Figure 5B:
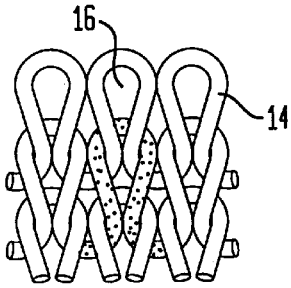
Figure 5C:
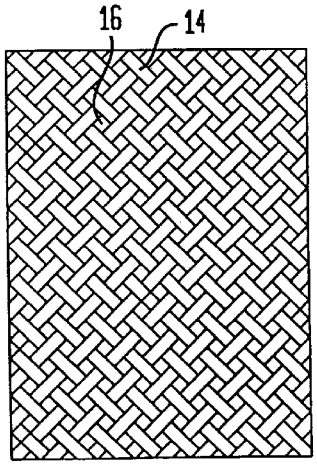

FIG. 1 shows an electrically conducting hinge 10 comprising an elongated strip 12. The strip 12 is formed from a plurality of intermeshed electrically conducting strands or fibers 14 formed into a fabric 16. The fabric 16 can be woven from the fibers, as shown in FIG. 5*a*, knitted, as shown in FIG. 5*b*, but preferably is formed by braiding as illustrated in FIG. 5*c* and described further below. The fibers 14 are preferably copper wires having a diameter between 1 and 10mils, with diameters between 4 and 5 mils being most preferred. Other electrically conductive material may also be used.

The strip 12 has two oppositely disposed edge portions 18 and 20 disposed longitudinally along it. Attachment points, for example, apertures 22, are arranged longitudinally along each edge portion. The apertures are sized to accept fasteners, such as the bolts 24 illustrated in FIG. 3, for attaching the hinge 10 to the components, such as the junction box halves 26*a* and 26*b* seen in FIGS. 3 and 4. Eyelets 28 are preferably disposed within the apertures 22 and served to reinforce the apertures, preventing the bolts 24 from bearing against and tearing through the fabric 16.

As seen in FIG. 1 there is a first plurality of apertures arranged in a first row along edge portion 18, and a second plurality of apertures arranged in second row along edge portion 20, the second row being opposite edge portion from the first row and spaced laterally therefrom.

Figure 2:
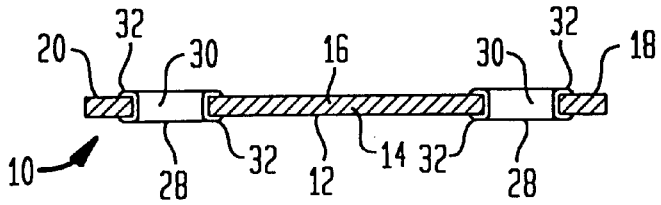
FIG. 2 shows a cross sectional view of the hinge taken along line 2—2 of FIG. 1.

As illustrated in FIG. 2, a typical eyelet 28 has a hollow barrel 30 located concentrically within aperture 22. Annular flanges 32 extend from either end of the barrel and are compressed against a respective surface of hinge 10 effecting an electrical connection between the eyelet and the hinge and retaining the eyelet to the hinge. Preferably, eyelets 28 are made of steel or another durable, strong material that is a good electrical conductor.

Figure 3:
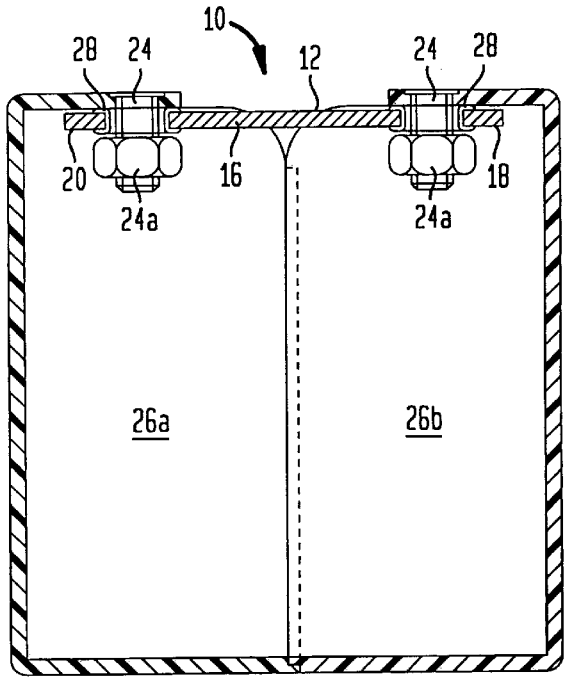
FIG. 3 shows a top view of a hinge connected between two relatively movable components of a junction box, the box being shown in the closed position.
Figure 4:
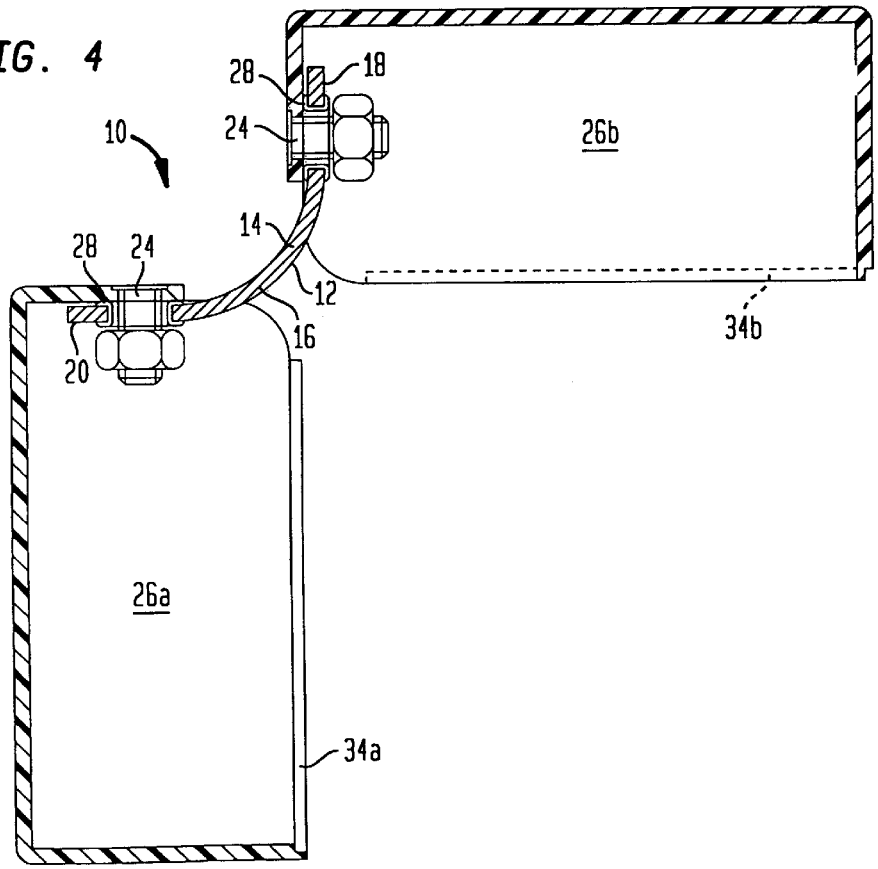
FIG. 4 shows a top view of the hinge and junction box of FIG. 3 in an open position.

As seen in FIGS. 3 and 4, hinge 10 provides a flexible joint which replaces a conventional hinge between components 26*a* and 26*b*, such as halves of a BEP or other electrical junction box as illustrated. In the figures, component 26*a* represents one half of the box fixed to a support, such as a wall of a building. Component 26*b* is hingedly attached to component 26*a* and pivots between an opened and a closed position on hinge 10. The hinge provides an excellent electrical connection between the components, and provides the only electrical connection when the components are in the open position illustrated in FIG. 4.

Because the hinge is formed like a fabric, it may have little or no stiffness in the direction normal to its surface. It is therefore desirable that the components 26*a* and 26*b* have interengaging lips 34*a* and 34*b* positioned on their mating edges. The lips interengage one another to lock the components together when in the closed position illustrated in FIG. 3. Otherwise component 26*b* would droop out of alignment with the fixed component 26*a* and fail to close properly. When in the open position however, relative alignment of the mating halves is not crucial and a small amount of droop or deflection is acceptable.

Forming the hinge by braiding the fibers provides greater stiffness in the plane of the hinge than would be obtained by knitting or weaving, and for this reason braiding is preferred. The braided fabric nevertheless maintains excellent flexibility in bending, thus providing a smooth hinging action.

The electrically conducting hinge according to the invention provides a good electrical connection between relatively movable components as well as a flexible hinge allowing the components to be readily rotated relative to one another. Such a hinge provides a replacement for conventional hinge and grounding strap constructions typically found in junction boxes such as BEP units where proper grounding of the unit is important both to system performance and safety.

What is claimed is:

1. An electrically conductive hinge for hingedly attaching two electrically conductive members movable relative to one another, said hinge comprising:

an elongated strip having multiplicity of electrically conducting flexible fibers formed into a fabric, said strip having first and second longitudinal edge portions oppositely disposed, a first plurality of apertures being arranged in a first row, a second plurality of apertures being arranged in a second row, said first row being disposed along said first edge portion, said second row being disposed along said second edge portion and laterally space from said first row, each said apertures being sized to accept fasteners for attaching said edge portion to one of the two members.

2. A hinge according to claim 1, wherein said electrically conducting flexible fibers are woven.

3. A hinge according to claim 1, wherein said electrically conducting flexible fibers are knitted.

4. A hinge according to claim 1, wherein said electrically conducting flexible fibers comprise copper wires.

5. A hinge according to claim 1, wherein said electrically conducting flexible fibers are braided.

6. A hinge according to claim 2, wherein said electrically conducting flexible fibers comprise copper wires having a diameter between 1 and 10 mils.

7. A hinge according to claim 1, further comprising at least one eyelet disposed within one of said apertures, said eyelet being formed from an electrically conducting material and having a hollow barrel portion located concentrically within said aperture and a pair of flanges.

8. A hinge according to claim 7, wherein one of said flanges extends substantially perpendicularly from each end of said barrel portion and is compressed against a respective surface of said strip in impinging contact thereon, said flanges effecting an electrical connection between said strip and said eyelet.

9. A hinge according to claim 7, wherein said eyelet is formed from steel.

10. A hinge according to claim 7, wherein each said flange comprises an annular rim extending circumferentially from each end of said barrel portion of said eyelet.

11. An electrical junction box, comprising;

first and second electrically conducting members; and a hinge movably attaching said first and second electrically conducting members, said hinge comprising a flexible strip formed from a plurality of intermeshed strands of electrically conducting fibers, said strip having oppositely disposed edge portions extending longitudinally along said strip, each said edge portion having a plurality of attachment points disposed longitudinally along said strip for attaching each said edge portion to a respective member of said first and second electrically conducting members, said attachment points comprising a plurality of apertures longitudinally disposed along each said edge portion in a spaced apart relationship, each said aperture being sized to accept a fastener for attaching each said edge portion to said respective electrically conducting member.

12. An electrical junction box according to claim 11, wherein said strands are intermeshed by means of weaving.

13. An electrical junction box according to claim 11, wherein said strands are intermeshed by means of knitting.

14. An electrical junction box according to claim 11, wherein said attachment points further comprise a plurality of eyelets, one said eyelet being disposed in each said aperture, each said eyelet being formed from an electrically conducting material and having a hollow barrel portion located concentrically within said aperture and a pair of flanges, one of said flanges extending substantially perpendicularly from each end of said barrel portion and compressed against a respective surface of said strip in impinging contact thereon, said flanges effecting an electrical connection between said strip and said eyelet.

15. An electrical junction box according to claim 11, wherein said fasteners comprise bolts with mating nuts.

16. An electrical junction box according to claim 11, wherein said junction box is a building entry protection unit.

17. An electrical junction box according to claim 11, wherein said strands are intermeshed by means of braiding.

18. An electrical junction box according to claim 17, wherein said electrically conducting fibers comprise copper wires.

19. An electrical junction box according to claim 18, wherein said copper wires have a diameter between 4 and 5 mils.

* * * * *